US006339403B1

(12) United States Patent
Desai

(10) Patent No.: US 6,339,403 B1
(45) Date of Patent: Jan. 15, 2002

(54) VEHICLE ANTENNA SYSTEM FOR MULTIPLE VEHICLE ELECTRONIC COMPONENTS

(75) Inventor: Tejas Bhupendra Desai, Sterling Height, MI (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/604,093

(22) Filed: Jun. 27, 2000

Related U.S. Application Data

(60) Provisional application No. 60/141,790, filed on Jun. 30, 1999.

(51) Int. Cl.[7] ..... H01Q 1/32
(52) U.S. Cl. ..... 343/713; 343/711
(58) Field of Search ..... 343/713, 725, 343/700 MS, 711; 33/134; 370/36, 37

(56) References Cited

U.S. PATENT DOCUMENTS

| | | | | |
|---|---|---|---|---|
| 3,656,162 A | | 4/1972 | Mee | 343/180 |
| 3,815,137 A | | 6/1974 | Kaegebein | 343/180 |
| 4,080,601 A | | 3/1978 | Alcorn, Jr. | 343/180 |
| 4,651,344 A | | 3/1987 | Hasegawa et al. | 455/325 |
| 4,692,726 A | | 9/1987 | Green et al. | 343/180 |
| 4,890,078 A | | 12/1989 | Radcliffe | 333/134 |
| 5,023,866 A | | 6/1991 | De Muro | 370/24 |
| 5,155,724 A | | 10/1992 | Edwards | 370/37 |
| 5,300,936 A | * | 4/1994 | Izadian | 343/700 MS |
| 5,898,406 A | | 4/1999 | Matero | 343/702 |
| 5,963,180 A | | 10/1999 | Leisten | 343/895 |

OTHER PUBLICATIONS

PCT International Search Report

* cited by examiner

*Primary Examiner*—Don Wong
*Assistant Examiner*—Hoang Nguyen

(57) ABSTRACT

An antenna system includes a diplexer connected to at least two vehicle electronic components which communicate through signals in spaced apart frequency bands. The antenna is coupled to the diplexer at a common branch. The radio is connected to a first equipment branch of the diplexer by a first transmission line and the RKE system is connected to a second equipment branch of the diplexer unit by a second transmission line. In a preferred embodiment, the first transmission line is of a length equal to one forth the wavelength of the second signal, while the second transmission line is of a length equal to one forth the wavelength of the first signal. Accordingly, by relating the length of the first and second transmission lines, each operates as a short in relation to the signal carried by the other which substantially eliminates attenuation.

14 Claims, 1 Drawing Sheet

VEHICLE ANTENNA SYSTEM FOR MULTIPLE VEHICLE ELECTRONIC COMPONENTS

This application claims benefit to U.S. Provisional No. 60/141,790 filed Jun. 30, 1999.

BACKGROUND OF THE INVENTION

This invention relates generally to vehicle electronic components which communicate in the electromagnetic spectrum. More particularly, this invention relates to a single vehicle antenna system which receives signals for a plurality of electronic components which operate in different spaced apart frequency bands.

Vehicles typically include a multiple of various electronic components. Each of the components typically operates in different spaced apart frequency bands. Examples of such electronic components include an FM radio, which operates at approximately 100 MHz, and remote keyless entry (RKE) systems, which operate at approximately 315 MHz. Each component must therefore include its own frequency specific antenna system.

Known antenna systems may include a diplexer which allows a single antenna to receive a different frequency for each associated vehicle electronic component. The diplexer typically has at least two branches. Each branch includes a band pass filter for passing signals in a portion of the frequency spectrum different from the portions passed by the other branches. Each component thereby receives only its particular operating signal. Each diplexer branch band pass filter passes only its particular signal while blocking all other signals. Each band pass filter also tends to attenuate the signals for the other branches. A transmitter of a higher power output or a more sensitive receiver must therefore be used for each vehicle component. The expense involved in increasing vehicle electrical components receiver sensitivity typically outweighs the benefits of providing a single antenna system.

Accordingly, it is desirable to combine a single antenna system with a plurality of vehicle components while minimizing the attenuation of the passed signals in one branch by the filter in another branch.

SUMMARY OF THE INVENTION

In general terms, this invention includes an antenna system connected to at least two vehicle electronic components which communicate through signals in spaced apart frequency bands. In one disclosed embodiment the first component is associated with a resonant frequency of an FM radio, which operates at approximately 100 MHz, and the second component is associated with a resonant frequency of an Remote Keyless Entry system (RKE), which operates at approximately 315 MHz.

The antenna is coupled to a diplexer at a common branch. The radio is connected to a first equipment branch of the diplexer by a first transmission line and the RKE system is connected to a second equipment branch of the diplexer unit by a second transmission line. In a preferred embodiment, the first transmission line is of a length equal to one quarter the wavelength of the second signal ($\lambda/4$ at 315 MHz), while the second transmission line is of a length equal to one quarter the wavelength of the first signal ($\lambda/4$ at 100 MHz).

The first transmission line which carries the 100 MHz first signal is matched to be a short circuit at 315 MHz and the second transmission line which carries the 315 MHz second signal is matched to be a short circuit at 100 MHz. At the diplexer, the 100 MHz signal of the first signal, is not affected by the 315 MHz signal of the second signal as the 315 MHz signal appears as an open circuit because of the $\lambda/4$ at 315 MHz length of the first transmission line. Conversely, the 315 MHz signal of the second signal, is not affected by the 100 MHz signal of the first signal as the 100 MHz signal appears as an open circuit because of the $\lambda/4$ at 100 MHz length of the second transmission line.

Accordingly, by relating the length of the first and second transmission lines, each operates as a short in relation to the signal carried by the other which substantially eliminates attenuation. Thus, instead of the passed signals being attenuated, only the passed signal is "seen" by the junction.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
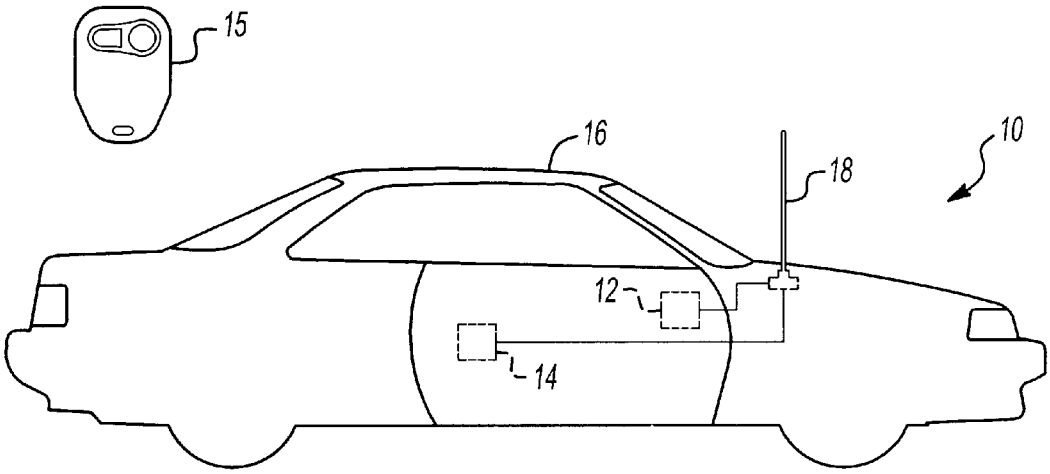
FIG. 1 is a diagrammatic, perspective illustration of a vehicle including an antenna system designed according to this invention.

FIG. 1 diagrammatically illustrates an antenna system 10 in accordance with the present invention. The arrangement illustrated in FIG. 1 is suitable for a number of applications in which multiple electronic components such as a vehicle radio (shown schematically at 12) and a remote keyless entry (RKE) system (shown schematically at 14) are required together.

The antenna system 10 comprises an antenna 16 in the form of an elongated member typically installed at an external location on a vehicle 18. The antenna 18 has two modes of resonance in spaced apart frequency bands. In the disclosed embodiment the first mode of resonance is associated with a resonant frequency of an FM radio 12, which operates at approximately 100 MHz, and a second mode of resonance at approximately 315 MHz typically used by the vehicle RKE system 14.

As is well known an "RF link budget" provides an effective model of how system components which transmit in the electromagnetic spectrum perform. The link budget can be analyzed using the following relationship:

$$P_R=P_T+G_{A1}+G_{A2}-G_{C1}-G_{C2}-10\log[(4*\pi*R)/\lambda]^2$$

Wherein:

| | |
|---|---|
| $P_T$ = transmitted power in dBW | $P_R$ = received power in dBW |
| $G_{A1}$ = transmitter antenna gain in dB | $G_{A2}$ = receiver antenna gain in dB |
| $G_{C1}$ = transmitter line loss in dB | $G_{C2}$= receiver line loss in dB |

R=range between antennae in meters $\lambda$=Carrier Frequency wavelength in meters In an RKE system 14 it is desirable to decrease the size of the RKE remote 15. As such, the RKE remote 15 typically includes a relatively small printed circuit board transmitter antenna. As it is not desirable to increase the RKE remote 15 antenna, and as can seen by the above link budget relationship, it is preferable to make use of the relatively larger vehicle antenna 18 commonly used for the vehicle radio system.

Figure 2:
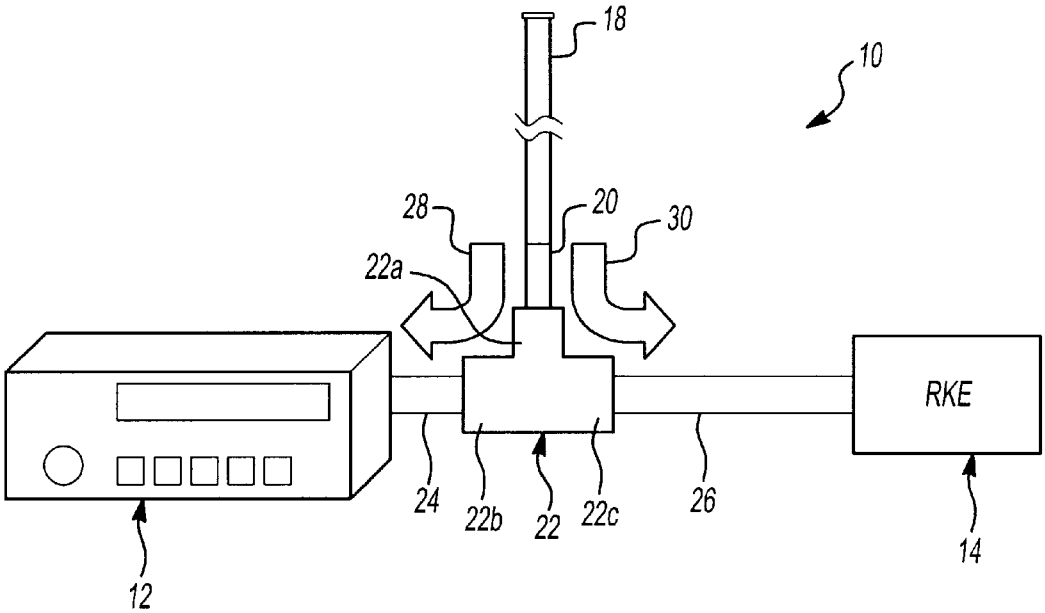
FIG. 2 is a block diagram of an antenna system of FIG. 1 designed according to this invention.

Referring to FIG. 2, the antenna system 10 is schematically illustrated. The antenna 18 is mounted to a conductive surface 20 which, in this embodiment, is coupled to a diplexer 22 at a common branch 22A. The radio 12 is connected to a first equipment branch 22B of the diplexer unit 22 by a first transmission line 24 and the RKE system 14 is connected to a second equipment branch 22C of the diplexer unit 22 by a second transmission line 26 to communicate with the antenna 18. The diplexer unit 22 provides impedance matching of the radio 12 and RKE system 14 to the antenna 18 in its different modes of resonance, and isolates the two units 12 and 14 so that they may be operated substantially independently. In other words, each equipment branch 22B, 22C acts as a filter to the other 22C, 22B, however, the diplexer also tends to attenuate the passed signals. It should also be realized that when the signals are far apart (approximately F1<2*F2) coaxial cable can be used to form the diplexer 22.

A first signal (schematically illustrated at 28) is to the radio 12 at 100 MHz and a second signal (schematically illustrated at 30) is to the RKE system 14 at 315 MHz. Although particular frequencies are presented in the disclosed embodiment it should be realized that other components operating at other frequencies will benefit from the present invention. The first transmission line 24 is of a length equal to one quarter the wavelength of the second signal 30, ($\lambda/4$ at 315 MHz) while the second transmission line 26 is of a length equal to one quarter the wavelength of the first signal 28, ($\lambda/4$ at 100 MHz). In a preferred embodiment, this results in a first transmission line 24 of approximately 23.8 cm in length and a second transmission line 26 of approximately 45 cm in length.

By relating the length of the first and second transmission line 24, 26, each operates as a short in relation to the signal carried by the other to substantially eliminate attenuation. The first transmission line 24 which carries the 100 Mhz first signal 28 is matched to be a short circuit at 315 MHz and the second transmission line 26 which carries the 315 Mhz second signal 30 is matched to be a short circuit at 100 MHz. At the diplexer 22, the 315 MHz signal of the second signal 30 is not affected by the 100 MHz band pass filter. The first transmission line 24 appears as an open circuit En z because it is $\lambda/4$ at 315 MHz. Conversely, the 100 MHz signal of the first signal 28 is not affected by the 315 MHz band pass filter. The second transmission line appears as an open circuit because it is $\lambda/4$ at 100 MHz. Thus, instead of the passed signals being attenuated, only the passed signal is "seen" by the junction.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. An antenna system, comprising:

a diplexer having a common branch in communication with a first equipment branch and a second equipment branch;

an antenna mounted to said common branch;

a first receiver component operating at a first signal frequency, said first receiver component communicating with said antenna through a first communication line having a first length connected to said first equipment branch, said first receiver component receiving signals having the first frequency that are collected by the antenna; and a second receiver component operating at a second signal frequency, said second receiver component communicating with said antenna through a second communication line having a second length connected to said second equipment branch, said first length having a dimensional relationship to said second signal frequency and said second length having a dimensional relationship to said first signal frequency, said second receiver component receiving signals having the second frequency that are collected by the antenna.

2. The antenna assembly according to claim 1, wherein said first signal is approximately 100 MHz.

3. The antenna assembly according to claim 1, wherein said second signal is approximately 315 MHz.

4. The antenna assembly according to claim 1, wherein said first length is approximately equal to one-quarter of the wavelength of said second signal.

5. The antenna assembly according to claim 1, wherein said second length is approximately equal to one-quarter of the wavelength of said first signal.

6. The antenna assembly according to claim 1, wherein said first receiver component is a portion of a vehicle radio.

7. The antenna assembly according to claim 6, wherein said second receiver component is a portion of a remote keyless entry system.

8. The system of claim 1, wherein the first signal frequency is approximately one-third the second signal frequency.

9. The system of claim 1, wherein the first length is about one-third of the second length.

10. A vehicle antenna system for receiving and processing signals in at least two distinct frequency bands, comprising:

a diplexer having a common branch in communication with a first equipment branch and a second equipment branch;

an antenna mounted to said common branch;

a first receiver that is responsive to a first signal having a first frequency, said first receiver communicating with said antenna through a first communication line having a first length connected to said first equipment branch; and a second receiver that is responsive to a second signal having a second frequency that is much higher than the first frequency, said second receiver communicating with said antenna through a second communication line having a second length connected to said second equipment branch, said first length is approximately equal to a multiple of one-quarter of the wavelength of said second signal and said second length is approximately equal to a multiple of one-quarter of the wavelength of said first signal.

11. The antenna system according to claim 10, wherein said first receiver is a portion of a vehicle radio that is responsive to a signal having a frequency of about 100 MHz.

12. The antenna system according to claim 11, wherein said second receiver is a portion of a remote keyless entry system that is responsive to a signal having a frequency of about 315 MHz.

13. The system of claim 10, wherein the first signal frequency is approximately one-third of the second signal frequency.

14. The system of claim 8, wherein the first length is about one-third of the second length.

* * * * *